US006304165B1

(12) United States Patent
Petri et al.

(10) Patent No.: US 6,304,165 B1
(45) Date of Patent: Oct. 16, 2001

(54) SWITCHING DEVICE FOR AN ELECTRIC HEATING DEVICE

(75) Inventors: Heinz Petri, Bretten; Siegfried Mannuss, Sternenfels; Eugen Wilde, Knittlingen, all of (DE)

(73) Assignee: E.G.O. Elektro-Geratebau GmbH (DE)

( * ) Notice: Subject to any disclaimer, the term of this patent is extended or adjusted under 35 U.S.C. 154(b) by 0 days.

(21) Appl. No.: 09/416,568

(22) Filed: Oct. 12, 1999

(30) Foreign Application Priority Data

Oct. 9, 1998 (DE) ..... 198 46 513

(51) Int. Cl.[7] ..... H01H 37/48; H01H 37/46

(52) U.S. Cl. ..... 337/394; 337/393; 337/398; 337/123

(58) Field of Search ..... 337/382, 383, 337/388, 389, 390, 391–394, 398, 123, 131, 139

(56) References Cited

U.S. PATENT DOCUMENTS

| | | | | |
|---|---|---|---|---|
| 2,496,229 | * | 1/1950 | Parkhurst | 337/389 |
| 2,559,372 | * | 7/1951 | Rike | 337/394 |
| 2,705,747 | * | 4/1955 | Strange | 337/394 |
| 2,721,915 | * | 10/1955 | Huntley | 337/389 |
| 3,004,123 | * | 10/1961 | Cannon | 337/393 |
| 3,029,329 | * | 4/1962 | Bolesky | 337/386 |
| 3,194,927 | * | 7/1965 | Place | 337/387 |
| 3,235,691 | | 2/1966 | Bixby et al. . | |
| 3,243,557 | | 3/1966 | Fairbanks . | |
| 3,327,946 | * | 6/1967 | Benson | 236/48 R |
| 3,899,765 | * | 8/1975 | Daigneault, Jr. | 337/386 |
| 4,400,679 | * | 8/1983 | Snider | 337/386 |
| 4,555,688 | * | 11/1985 | Bayer | 337/394 |
| 4,577,176 | * | 3/1986 | Bayer | 337/394 |
| 4,633,238 | * | 12/1986 | Goessler et al. | 340/593 |
| 4,665,307 | * | 5/1987 | McWilliams | 219/448.19 |
| 4,695,816 | * | 9/1987 | Essig et al. | 337/394 |
| 4,901,049 | * | 2/1990 | Kicherer et al. | 337/394 |
| 5,055,819 | * | 10/1991 | Goessler et al. | 337/394 |
| 5,310,993 | * | 5/1994 | McWilliams et al. | 219/448.19 |
| 5,627,507 | * | 5/1997 | Morbitzer et al. | 337/394 |

FOREIGN PATENT DOCUMENTS

| | | |
|---|---|---|
| 28 39 161 | 3/1980 | (DE) . |
| 35 40 414 | 5/1987 | (DE) . |
| 44 37 620 | 6/1995 | (DE) . |

* cited by examiner

*Primary Examiner*—Gerald Tolin
*Assistant Examiner*—Anatoly Vortman
(74) *Attorney, Agent, or Firm*—Akerman Senterfitt

(57) ABSTRACT

According to the invention a switching device (11) for an electric heating device is provided with a rod-shaped temperature sensor (15) formed by a ceramic rod (17) and an extension tube (16). The temperature sensor (16) operates a snap-action switch (22) located in a base (12) by means of an actuator separate from the said switch, which has at least one actuating part (41), which is loaded in the actuating direction by a leaf spring (34), the actuating part (41) and leaf spring (34) being in one piece. In a further development of the invention the leaf spring (34) or actuating part (41) can be a receptacle for an adjusting device, preferably an adjusting screw (38).

22 Claims, 1 Drawing Sheet

SWITCHING DEVICE FOR AN ELECTRIC HEATING DEVICE

FIELD OF APPLICATION AND PRIOR ART

The invention relates to a switching device for an electric heating device with a substantially rod-shaped temperature sensor, which comprises a tube and a longitudinal element located therein, the tube and the longitudinal element having different thermal expansion coefficients, and with at least one switch located in a base and operated by the temperature sensor and which is provided with a switch spring, particularly a catch spring, the temperature sensor tripping the switch by means of an actuator separate from the switch spring, the actuator having at least one actuating part, which is loaded by a spring element in or counter to the actuating direction.

A switching device of the aforementioned type is e.g. known from DE-OS 28 39 161. The latter has as an actuator a unilaterally mounted lever through which is guided a rod-like longitudinal element. Fixing takes place by means of a helical spring supported on the base and which presses the lever against a nut guided by means of a screw thread at the end of the rod. The nut running on the rod screw thread serves as an adjusting device. In the lever are inserted two actuating pins, which in each case point in opposite directions and operate two switches.

PROBLEM AND SOLUTION

The problem of the invention is to provide such a switching device, which obviates the disadvantages of the prior art and in particular reduces assembly costs and permits reliable operation.

This problem is solved by the features of claim 1. Advantageous developments of the invention form the subject matter of the subclaims.

An inventive, one-part construction of the at least one actuating part with the spring element in particular facilitates assembly, but other advantages can also result therefrom. As a result of the one-part nature it is possible to save at least one fixing or mounting means, particularly for at least one actuating part. A fixed association or connection between the actuating part and the spring element increases the mechanical reliability of the switching device, because a disadjustment is avoided.

An actuator can be supported in leaf spring-like manner on the base, particularly with both end regions for increasing the spring action. The longitudinal element can act on the actuator, which preferably has at least one actuating part for bearing on the switch.

Preferably the spring element and the at least one actuating part and/or the actuator are rough-worked from a single material piece. A particularly simple construction can be rough-worked from a flat material and correspondingly shaped by bending. Another possibility is e.g. a fixed connection by bonding or welding and optionally also by extrusion. This in particular covers a one-part configuration allowing the objects in the fitted state to act as a single part, in which the individual parts have in at least one other direction than the assembly direction a positive engagement.

The spring element is preferably constructed as a compression spring in order to ensure precise working. The spring element is preferably leaf spring-like. A leaf spring is advantageously mounted with both end regions or ends in the base, particularly by engagement on engagement areas brought about by spring tension. A leaf spring advantageously runs substantially at right angles to the extension direction of the temperature sensor, so that it is possible to avoid undesired shear forces or the like.

In a particularly preferred manner the temperature sensor engages or bears roughly centrally on the leaf spring, so that there is a uniform loading thereof. The actuating part advantageously runs in the vicinity of the temperature sensor and is in particular positioned roughly centrally on the leaf spring.

The actuating part advantageously has two legs projecting from the spring element for bearing on the switch and it is in particular roughly U-shaped. The U-shaped legs are preferably twisted by approximately 90° to the longitudinal extension of the leaf spring. The legs can in each case be led to different switches, but preferably engage on the same switch. The temperature sensors can directly point into or run into the U-shape.

Preferably a mechanical connection between the temperature sensor and the actuator is an adjustable transfer means, particularly an adjusting device. The adjusting device advantageously engages on the temperature sensor, particularly on the end thereof. The adjusting device preferably engages on the longitudinal element, which can project over the tube.

A preferred bearing possibility for the adjusting device is on the actuator and is in particular fixed thereto. In one construction possibility it can engage on or be received in the centre of a U-shaped actuating part. As another advantageous possibility the spring element has a receptacle for the adjusting device, particularly in the case of a one-piece construction of spring element and actuating part.

A receptacle for the adjusting device can be a thread for an adjusting screw, which preferably runs in the direction of the longitudinal element and/or in the actuating direction of the switch. The adjustment precision can be varied by modifying the pitch of the adjusting screw.

The transfer of the actuating force can be through the switch and/or switch spring, particularly through a corresponding opening, which for stability reasons should not be open to the rim. As a function of the assembly type the longitudinal element can pass through one side or the adjusting device or screw on the other.

Advantageously the longitudinal element is at least partly constructed as a rod and is in particular completely in the form of a rod. It is possible in the case of a temperature sensor, which covers differently heatable heating areas of a heating device, to associate with in each case one heating area a rod area or a separate rod with characteristics adapted thereto. The rods are then successively placed in the tube, so that their individual extensions can be summated to an overall extension. However, in particularly preferred manner the longitudinal element is constructed as a one-piece rod. Advantageously the longitudinal element has a lower expansion coefficient than the tube and e.g. ceramic or glass can be used as its material.

According to an embodiment the at least one actuating part can substantially embrace the rod and preferably engages externally in the end region thereof. It advantageously forms a guide for the rod, particularly for securing the rod against undesired movement transversely to the actuating direction. A positive connection between the actuating part in a plane at right angles to the actuating direction can prevent an undesired, mutual shifting of the parts. A guide can be constructed as an inward curvature of the at least one actuating part towards the rod. The inward curvature is preferably provided with a recess corresponding to the external diameter of the rod in or along which runs said rod. Guidance by an adjusting screw can be in the form of a tubular portion engaging over the rod, e.g. in the form of a bore in the end face of the adjusting screw.

An overpressure preventer for the switch can be implemented by the actuating part having a certain elasticity in the actuating direction. This can be obtained by at least one S-shaped or Z-shaped bend, preferably as an inward curvature in the form of a spring bend or elbow, which can be combined with the above-described guide.

Preferably the leaf spring in the base is mounted in a reception chamber, which has in particular bearing areas for the leaf spring pointing counter to the actuating direction. The reception chamber can widen in the leaf spring bending direction as from the bearing areas. The leaf spring preferably engages on through base walls, which serve as bearing areas and limit widening. Preferably the widening is roughly symmetrical, particularly symmetrical to a plane running along the actuating direction. A mobility of the leaf spring in the reception chamber can be obtained in that at the point of maximum width the reception chamber exceeds the leaf spring length. Thus, on relaxing, the leaf spring can expand laterally. An insertion of the leaf spring is also simpler if, in the untensioned state, it has a certain clearance in the reception chamber.

For thermal, strength and insulating reasons, a ceramic material, e.g. steatite, is suitable as the material for the base. The base can substantially form the casing for the switching device and have all the walls and supports and it is merely necessary to cover it by a simple, substantially flat cover.

These and further features can be gathered from the claims, description and drawings and the individual features, either singly or in the form of subcombinations, can be implemented in an embodiment of the invention and in other fields and can represent advantageous, independently protectable constructions for which protection is hereby claimed. The subdivision of the application into individual sections and the subtitles in no way limits the general validity of the statements made thereunder.

BRIEF DESCRIPTION OF THE DRAWINGS

The invention is described in greater detail hereinafter relative to two preferred embodiments and the attached drawings, wherein show.

DETAILED DESCRIPTION OF THE EMBODIMENTS

Figure 1:
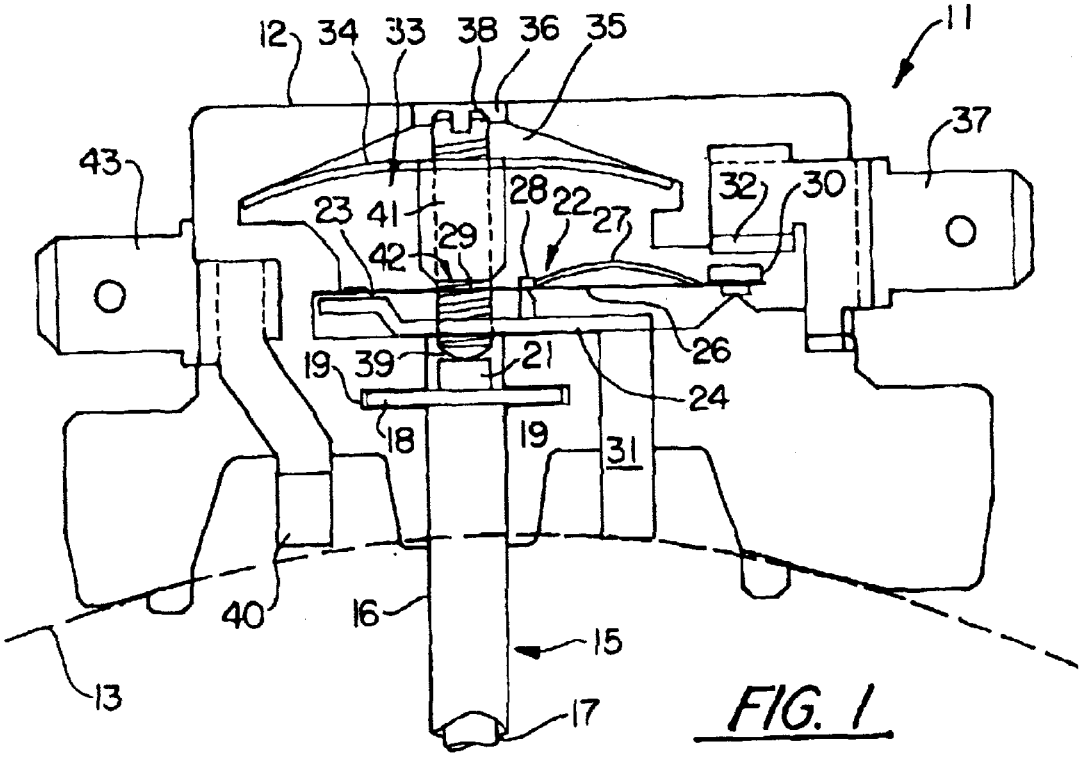
FIG. 1 A plan view of a switching device according to the invention with a leaf spring, which has two legs operating a switch as the actuating part.

FIG. 1 shows a switching device 11 according to the invention, which has a base 12, which contains or carries all the components.

The base 12 can be fixed in not shown manner, e.g. by means of twisting tongues and engagement cams, on a sheet metal tray rim 13 (shown in broken line form) of a sheet metal tray containing a radiant heater. A rod-shaped temperature sensor 15 projects in known manner at least partly and preferably completely over the heater.

The temperature sensor 15 comprises an outer tube 16 and a rod 17 located therein. In the represented embodiment the rod 17 is made from ceramic material and the outer tube 16 from a metal with a much higher expansion coefficient. The upper end of the outer tube 16 has a transversely projecting collar 18, to which it is firmly connected and which engages in lateral reception slots 19 in order to fix the tube 16. In the represented embodiment the rod 17 projects somewhat over the collar 18 of tube 16. At the not shown end of the temperature sensor 15 the tube 16 is closed, the rod 17 either being applied or fixed to the tube end.

In a free space above the rod end 21 is located a snap-action switch 22, whereof a free end 23 is fixed to a switch support 24. The subsequently described snap effect of the snap-action switch 22 is brought about by a spring clip 27 running centrally between two spring legs 26 and which is supported on a bearing 28 of the switch support 24. At its other, free end the snap-action switch 22 carries an upwardly directed switching contact head 30, which faces a counter-contact head 32, which is fitted to a plug-in connecting lug 37. The switch support 24 is fixed both by engagement of the area carrying the free end 23 of the snap-action switch 22 in a matching recess of the base 12 and by the path of a connecting lug 31 through a passage in the base 12. Together with a second connecting lug 40 and a second plug-in connecting lug 43 connected thereto, the connecting lug 31 is used for the electrical contacting of a not shown heating means by means of the connecting lugs. The switch 22 interrupts the connection between the plug-in connecting lug 37 and connecting lug 31, the interruption state being shown in FIG. 1.

Both the switch support 24 and also the snap-action switch 22 have a covering opening located in the extension of the rod 17. On either side of said opening the snap-action switch 22 has two switch protuberances 29 produced by inward curvature.

The space in which the snap-action switch 22 is located passes outwardly into a reception chamber 33 for a leaf spring 34 as a spring element.

Towards the outside an extension 35 is connected to the reception chamber 33 and into it is bent the leaf spring 34. The widening is approximately triangular, symmetrical to the longitudinal axis of the rod 17 and issues into an opening 36.

An adjusting spring 38 is centrally mounted in the leaf spring 34, preferably by a thread fitted in said spring 34. The upper end of the adjusting screw 38 is accessible through the opening 36, even when the base 12 is closed, for adjusting the switching device 11. The screw tip 39 engages on the rod end 21 and has a rounded or spherical construction.

Alternatively the screw tip 39 can engage somewhat with a tubular portion as a guide over the rod end 21 in order to avoid slipping off. It is also possible to have a pin or peg on the screw tip 39, which engage in a depression on the face of the rod end 21 and exert the same action.

On both sides of the adjusting screw 38 the leaf spring 34 has an outgoing, downwardly bent leg 41 as an actuating part. The lower edge 42 of the legs 41 engage on the switch protuberances 29 of the snap-action switch 22 in the switching state shown.

Function

The switching device shown in FIG. 1 essentially functions as follows:

Through the tensioned leaf spring 34 the adjusting screw 38 presses the rod 17 against the end of the outer tube 16. When the heating means is in the cold state the bending of the leaf spring 34 is such that the legs 41 or the lower edge 42 are located well above the snap-action switch 22 or the switch protuberance 29. The free end 23 of the snap-action switch 22 is fixed to the switch support 24 in such a way that the spring legs 26 are above the engagement of the spring clip 27 on the bearing 28 and the switching contact head 30 engages on the countercontact head 32.

If the heating means is now put into operation, it evolves heat through which the outer tube 16 expands much more strongly than the rod 17, so that the rod end 21 migrates from the leaf spring 34 towards the collar 18. As a result the leaf spring 34 can relax downwards and the legs 41 move towards the snap-action switch 22. At a specific settable temperature with a corresponding expansion of the outer tube 16 it is possible to precisely set the point by twisting the adjusting screw 38 at which the legs 41, by engaging on the switch protuberances 29, have pressed the spring legs 26 on the bearing 28, accompanied by the engagement of the spring clip 27. As this is the switching or snapping over point of the snap-action switch 22, the spring clip 27 suddenly presses the end with the switching contact head 30 away from the countercontact head 32 in the downwards direction. The switch is consequently tripped at a settable temperature. One application example is an excess temperature preventer for a radiant heating under a glass ceramic hob, which is intended to respond e.g. at a temperature of approximately 650° C. By opening the switch the power supply to the heating device is interrupted and the risk of overheating the glass ceramic is avoided. As a result of the following cooling of the outer tube 16 it contracts again, presses the rod 17 upwards, which once again moves the leaf spring 34 and consequently the legs 41 upwards and away from the switch protuberances 29, so as to bring about a reclosing of the switch 22.

Figure 2:
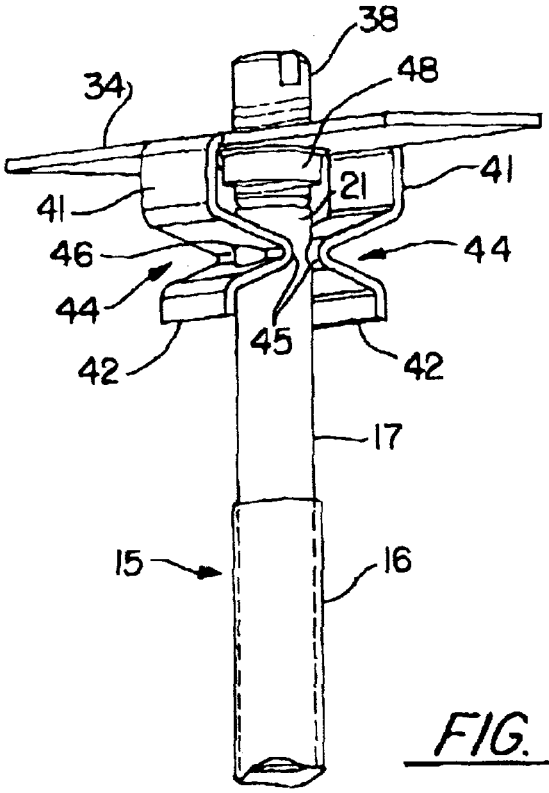
FIG. 2 An oblique view of a variant of the leaf spring of FIG. 1 with legs, which have an inwardly drawn curvature for guiding a rod of the temperature sensor.

A variant of the legs 41 of leaf spring 34 is shown in FIG. 2. The legs 41 emanating from the substantially elongated, rectangular leaf spring 34 have in their path an inward curvature 44, which is roughly spring elbow-like. Behind the inward curvature 44 the legs 41 move apart again, but with a smaller mutual spacing than upstream of the curvature 44. Inward curvatures 44 are in particular advantageous in those constructions in which the rod 17 extends between the legs 41.

To the inner edge 45 of the inward curvature 44 is fitted a recess 46, which is arcuate in the rod direction and in which the rod 16 is guided. In the examples shown the recesses 46 are sufficiently deep for the inner edges 45 of the curvature 44 to approach one another to within half a rod diameter. This permits an adequate embracing of the rod 16, which secures the rod transversely against a movement with respect to the legs 41. The recesses 46 can engage with a certain force on the rod 17, because a relative movement between rod and legs only occurs during the adjustment process.

Another advantage of the spring elbow-like inward curvatures 44 is that is possible to have a certain spring action between the adjusting screw 38 or the upper part of the legs 41 connected rigidly thereto in the rod direction and the lower portions of the legs 41 or the lower edges 42. This can prevent an overpressing of the snap-action switch 22 or at least partly reduce the same. However, in order to ensure a precise switching, spring action must not be too weak.

In the centre of the leaf spring 34 is provided a threaded nozzle 48 drawn downwards from the spring and having the reception thread for the adjusting screw 38.

What is claimed is:

1. A switching device for an electric heating device comprising:

a base;

a substantially rod-shaped temperature sensor, said temperature sensor comprising a tube and a longitudinal element located therein, said tube and said longitudinal element having different thermal expansion coefficients;

at least one switch arranged in the base and operated by said temperature sensor and being provided with a switch spring, particularly a catch spring;

an actuator separate from said switch and having at least one actuating part, said actuating part being loaded along the actuating direction by a spring element and being constructed in one piece with said spring element;

said temperature sensor tripping said switch by means of said actuator.

2. The switching device according to claim 1, wherein said actuator is supported in leaf spring-like manner on said base, said longitudinal element engaging on said actuator.

3. The switching device according to claim 2, wherein said actuator has at least one actuating part for bearing on the switch.

4. The switching device according to claim 1, wherein said spring element and said at least one actuating part are rough-worked from a single material piece.

5. The switching device according to claim 1, wherein said spring element is a leaf spring.

6. The switching device according to claim 5, wherein said spring element runs substantially transversely to the extension direction of said temperature sensor.

7. The switching device according to claim 5, wherein said temperature sensor engages roughly centrally on said spring element.

8. The switching device according to claim 5, wherein said at least one actuating part is roughly centrally positioned on said spring element.

9. The switching device according to claim 1, wherein said at least one actuating part has two legs projecting from said spring element for bearing on said switch.

10. The switching device according to claim 1, wherein an adjusting device is a mechanical connection between said temperature sensor and said actuator.

11. The switching device according to claim 10, wherein said adjusting device engages on said temperature sensor.

12. The switching device according to claim 10, wherein said adjusting device is mounted on said actuator.

13. The switching device according to claim 10, wherein said spring element has a receptacle for said adjusting device.

14. The switching device according to claim 13, wherein said receptacle is a thread for an adjusting screw as the adjusting device, said adjusting screw running in the actuating direction of said switch.

15. The switching device according claim 1, wherein said longitudinal element is a rod and said at least one actuating part substantially embraces said rod.

16. The switching device according to claim 15, wherein said at least one actuating part forms a guide for said rod for securing against a movement of said rod transversely to the actuating direction.

17. The switching device according to claim 16, wherein said guide is an inward curvature of said at least one actuating part towards said rod.

18. The switching device according to claim 17, wherein said inward curvature is provided with a recess corresponding to the external diameter of said rod, engaging with it on said rod.

19. The switching device according to claim 1, wherein said at least one actuating part has an elasticity in the actuating direction.

20. The switching device according to claim 19, wherein said elasticity is formed by at least one inward curvature in the manner of a spring elbow.

21. The switching device according to claim 5, wherein said leaf spring in said base is mounted in a reception chamber with bearing areas, the reception chamber widening from the bearing areas in the bending direction of said leaf spring.

22. The switching device according to claim 21, wherein said widening is roughly symmetrical.

* * * * *